US005676164A

United States Patent [19]

Martin

[11] Patent Number: 5,676,164

[45] Date of Patent: Oct. 14, 1997

[54] TOBACCO CURING PROCESS AND APPARATUS FOR IMPLEMENTING THE PROCESS

[75] Inventor: Mario Martin, Silea, Italy

[73] Assignee: Comas-Costruzioni Macchine Speciali-S.P.A., Silea, Italy

[21] Appl. No.: 525,661

[22] PCT Filed: Apr. 12, 1994

[86] PCT No.: PCT/EP94/01122

§ 371 Date: Sep. 29, 1995

§ 102(e) Date: Sep. 29, 1995

[87] PCT Pub. No.: WO94/23596

PCT Pub. Date: Oct. 27, 1994

[30] Foreign Application Priority Data

Apr. 20, 1993 [IT] Italy ..... VE93A0013

[51] Int. Cl.[6] ..... A24B 3/04; A24B 3/12

[52] U.S. Cl. ..... 131/305; 131/290

[58] Field of Search ..... 131/305

[56] References Cited

U.S. PATENT DOCUMENTS

| | | | |
|---|---|---|---|
| 4,730,627 | 3/1988 | Burcham, Jr. et al. | 131/305 |
| 4,887,619 | 12/1989 | Burcham, Jr. et al. | 131/305 |
| 5,425,384 | 6/1995 | White | 131/305 |

FOREIGN PATENT DOCUMENTS

| | | | |
|---|---|---|---|
| 0273596 | of 0000 | European Pat. Off. . | |
| 3001734 | of 0000 | Germany . | |
| 1813620 | 8/1970 | Germany | 131/305 |
| 2135637 | 2/1973 | Germany | 131/305 |
| 0004679 | 4/1991 | WIPO | 131/305 |

*Primary Examiner*—Vincent Millin
*Assistant Examiner*—William J. Deane, Jr.
*Attorney, Agent, or Firm*—Hoffman, Wasson & Gitler

[57] ABSTRACT

A tobacco curing process including the steps of advancing the tobacco in strip form within a rotary cylinder, spraying the strips with an atomized mixture of substances able to improve the tobacco characteristics, spraying with a steam jet, during the curing treatment, discrete zones of the inner lateral surface of said cylinder, thus exercising a mechanical scraping action.

4 Claims, 1 Drawing Sheet

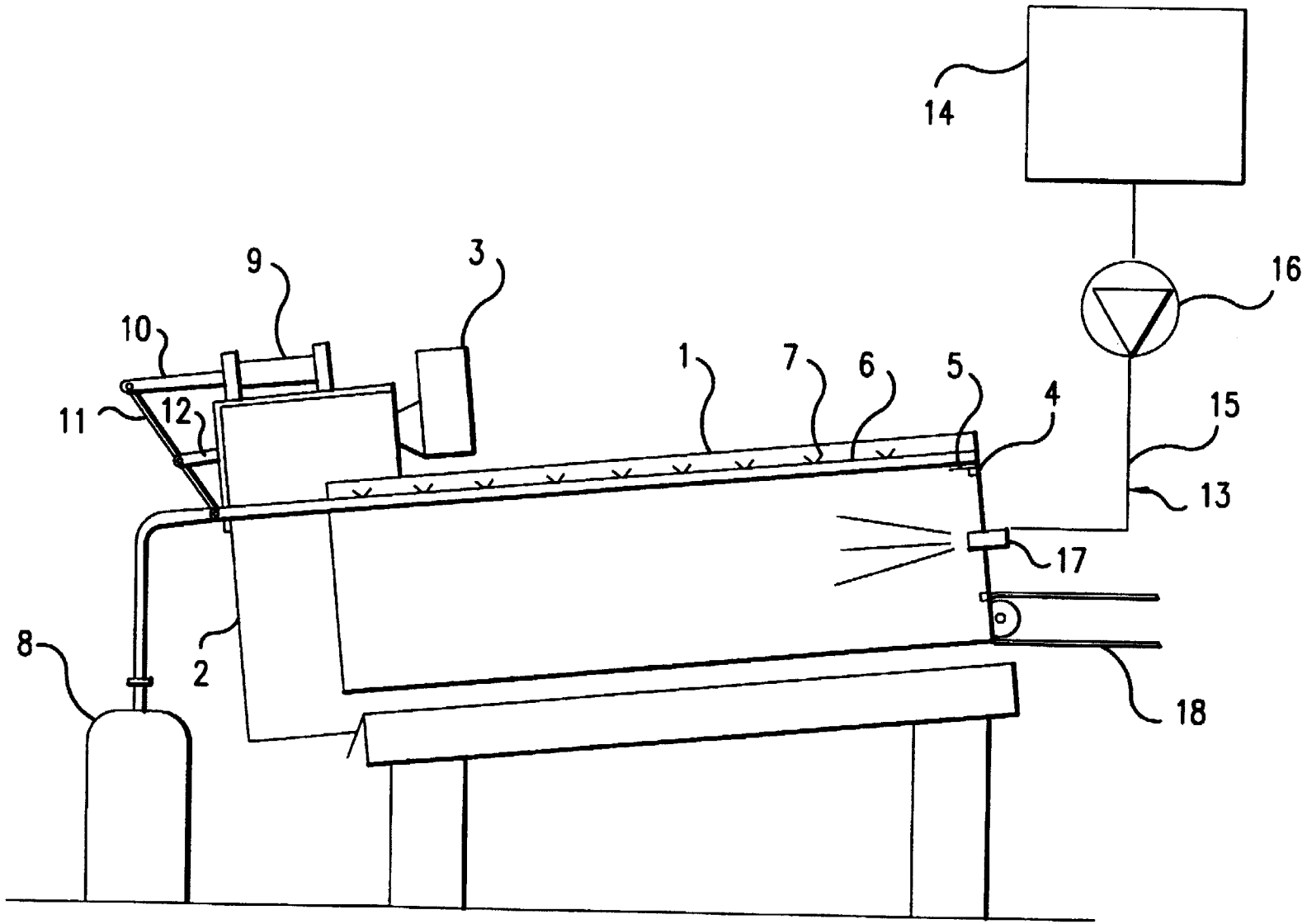
16
15
13
18
14
17
4
5
6
7
1
3
9
10
12
11
2
8

TOBACCO CURING PROCESS AND APPARATUS FOR IMPLEMENTING THE PROCESS

FIELD OF INVENTION

This invention relates to a tobacco curing process and an apparatus for implementing the process.

BACKGROUND OF INVENTION

Tobacco processing includes a treatment known as "curing" by which the tobacco is treated with a solution based on sugar, liquorice and quantities of mineral salts.

This treatment, the purpose of which is to improve the tobacco characteristics, is generally effected using a rotary cylinder containing the tobacco in the form of leaf pieces (strips) which are sprayed with this solution heated to 70°–80° C. and atomized with steam.

The particular temperature conditions and the type of substances used means that during curing, a part of the tobacco leaves compresses together to the cylinder walls, with consequent loss of tobacco leaves.

In the subsequent drying stage, that part of the compressed leaves which separates from the cylinder cannot be dried effectively, so that there is a further loss of tobacco.

To obviate this drawback it has been proposed to use a rotating brush which slides against the inner walls of the cylinder, however this solution has further drawbacks, and in particular:

a loss of time at the end of the process for cleaning the brush, to which the compressed strips remain attached, and a considerable loss of strips.

DISCUSSION OF THE PRIOR ART

DE-A-3001734 describes a rotary drum provided with an axially arranged steam pipe that is provided with a number of holes bored in the wall of the pipe. Steam is ejected from these holes and is directed upwardly against the inner wall of the drum to remove any tobacco particles which may adhere to this inner wall.

EP-A-0273596 discloses a method for treating particulate material with a liquid additive in a rotatable cylinder involving the use of a pressurized fluid such as steam directed obliquely against the inner wall of the cylinder via nozzles to effect a cleaning action on the inner wall.

SUMMARY OF THE INVENTION

An object of the invention is to provide a process which enables the inner walls of the cylinder to be maintained constantly clean without increasing the operating cost or the loss of tobacco leaves.

This object and further ones which will result from the following description are attained according to the invention through a tobacco curing process comprising the steps of:

a) advancing the tobacco in strip form within a rotary cylinder, b) spraying said strips with an atomized mixture of substances able to improve the tobacco characteristics, c) spraying with a steam jet through reciprocating motion along the longitudinal axis of said rotary cylinder, during the curing treatment, discrete zones of the inner lateral surface of said cylinder, thus exercising a mechanical scraping action.

To implement the process the invention uses an apparatus comprising a rotary cylinder provided with a feed opening for tobacco strips and a discharge hopper, said cylinder housing a pipe feedable with steam, said pipe being arranged parallel to the cylinder axis and being provided with a plurality of spray nozzles facing the surface of said cylinder wherein said pipe is axially movable.

BRIEF DESCRIPTION OF THE DRAWING

A preferred embodiment of the present invention is described hereinafter with reference to the accompanying drawing, which represents a schematic side view of an apparatus for implementing the process of the invention.

DESCRIPTION OF THE PREFERRED EMBODIMENTS

As can be seen from the drawing, the tobacco curing process according to the invention uses a rotary cylinder 1 arranged slightly inclined, it being open at the feed end for the tobacco leaf pieces (strips) and closed at its other end by a discharge hopper 2.

The discharge hopper 2 is provided with a centrifugal fan 3 able to create a slight vacuum within the rotary cylinder 1.

The cylinder 1 is provided at its entry opening with an annular flange 4 on which there is mounted a bracket 5 provided with slide guides for a pipe 6 arranged parallel to the axis of the cylinder substantially at its lateral surface, and provided with a plurality of spray nozzles 7 facing said surface.

The pipe 6 is fed with steam from a boiler 8.

Externally to the cylinder at the opposite end to the bracket there is mounted a further bracket for supporting a hydraulic cylinder-piston unit 9, to the rod 10 of which there is pivoted a bar 11 having its other end pivoted to the pipe 6. The bar 11 is also pivoted in its centre to an arm 12.

The apparatus also comprises a spray device, indicated overall by 13 and consisting of a tank 14 for a mixture suitable for the curing treatment, a pipe 15 with a feed pump 16, and a spray nozzle 17 facing the interior of the cylinder.

With the process of the invention the tobacco strips conveyed along a feed belt 18 are introduced into the rotary cylinder 1 and are treated with the curing mixture delivered via the atomizer nozzle 17.

Steam is simultaneously fed, to emerge from the spray nozzles 7 and exerts a mechanical scraping action on the walls of the cylinder 1, so preventing formation of tobacco leaf accumulations.

During this stage the rod 10 is moved reciprocatingly, with consequent axial movement of the pipe 6 in both directions. In this manner, virtually total cleaning of the cylinder can be achieved with a minimum quantity of steam.

I claim:

1. A tobacco curing process comprising the steps of:

a) advancing the tobacco in strip form within a rotary cylinder, b) spraying said strips with an atomized mixture of substances able to improve the tobacco characteristics, c) spraying with a steam jet, during curing treatment, discrete zones of the inner lateral surface of said cylinder, thus exercising a mechanical scraping action characterized by spraying said steam jet with a reciprocating motion along the longitudinal axis of said rotary cylinder.

2. A process as claimed in claim 1, wherein said spraying step is done on the inner lateral surface of the cylinder in its upper region.

3. An apparatus as recited in claim 4, wherein said pipe is axially movable under control of a level operated by a hydraulic cylinder-piston unit.

4. An apparatus for curing tobacco comprising:

a rotary cylinder having a feed opening for tobacco strips, a discharge hopper, said rotary cylinder housing a pipe, having a flow of steam therein, said pipe being arranged parallel to an axis of said rotary cylinder and being provided with a plurality of spraying nozzles facing a surface of said cylinder to spray said strips with an atomized mixture of substances able to improve the tobacco characteristics, wherein a steam jet is sprayed onto discrete zones of an inner lateral surface of the rotary cylinder in a reciprocating motion along a longitudinal axis of said rotary cylinder by moving said pipe axially.

* * * * *